US005774851A

United States Patent [19]

Miyashiba et al.

[11] Patent Number: 5,774,851

[45] Date of Patent: Jun. 30, 1998

[54] SPEECH RECOGNITION APPARATUS UTILIZING UTTERANCE LENGTH INFORMATION

[75] Inventors: Koichi Miyashiba; Yasunori Ohora, both of Atsugi, Japan

[73] Assignee: Canon Kabushiki Kaisha, Tokyo, Japan

[21] Appl. No.: 446,077

[22] Filed: May 19, 1995

Related U.S. Application Data

[63] Continuation of Ser. No. 141,720, Oct. 26, 1993, abandoned, which is a continuation of Ser. No. 549,245, Jul. 9, 1990, abandoned, which is a continuation of Ser. No. 896,069, Aug. 13, 1986, abandoned.

[30] Foreign Application Priority Data

| | | | |
|---|---|---|---|
| Aug. 15, 1985 | [JP] | Japan | 60-178510 |
| Dec. 20, 1985 | [JP] | Japan | 60-285792 |
| Dec. 20, 1985 | [JP] | Japan | 60-285794 |

[51] Int. Cl.[6] ..... G10L 5/06

[52] U.S. Cl. ..... 704/252; 704/247; 704/248

[58] Field of Search ..... 381/41–47; 395/2.4–2.66; 704/231, 232, 233, 234, 256, 252, 247, 214, 216, 250, 255, 251, 246, 248, 253

[56] References Cited

U.S. PATENT DOCUMENTS

| | | | |
|---|---|---|---|
| 4,181,821 | 1/1980 | Pirz et al. | 395/2.61 |
| 4,389,109 | 6/1983 | Taniguchi et al. | 381/43 |
| 4,403,114 | 9/1983 | Sakoe | 395/2 |
| 4,489,434 | 12/1984 | Moshier | 381/43 |
| 4,516,215 | 5/1985 | Hakaridani et al. | 381/43 |
| 4,590,605 | 5/1986 | Hataoka et al. | 395/2.54 |
| 4,597,098 | 6/1986 | Noso et al. | 381/46 |
| 4,618,983 | 10/1986 | Nishioka et al. | 381/43 |
| 4,677,673 | 6/1987 | Ukita et al. | 381/43 |
| 4,707,857 | 11/1987 | Marley et al. | 381/43 |
| 4,712,243 | 12/1987 | Ninomiya et al. | 381/43 |
| 4,715,004 | 12/1987 | Kabasawa et al. | 364/513.5 |
| 4,821,325 | 4/1989 | Martin et al. | 381/46 |

FOREIGN PATENT DOCUMENTS

| | | | |
|---|---|---|---|
| 8404620 | 11/1984 | WIPO | 381/43 |

*Primary Examiner*—Allen R. MacDonald
*Assistant Examiner*—Richemond Dorvil
*Attorney, Agent, or Firm*—Fitzpatrick, Cella, Harper & Scinto

[57] ABSTRACT

An apparatus includes a speech pattern memory, a microphone, an utterance length detector circuit, an utterance length selector circuit, switches, and a pattern matching unit. The speech pattern memory stores a plurality of standard speech patterns grouped in units of utterance lengths. The utterance length detector circuit detects an utterance length of speech data input at the microphone. The utterance length selector circuit and the switches cooperate to read out standard speech patterns from a speech pattern memory corresponding to the utterance length detected by the utterance length detector circuit. The pattern matching unit sequentially compares the input speech pattern with the standard speech patterns sequentially read out in response to a selection signal from the utterance length selector circuit and performs speech recognition.

10 Claims, 6 Drawing Sheets

SPEECH RECOGNITION APPARATUS UTILIZING UTTERANCE LENGTH INFORMATION

This application is a continuation of application Ser. No. 08/141,720 filed Oct. 26, 1993, now abandoned, which is a continuation of application Ser. No. 07/549,245, filed Jul. 9, 1990, now abandoned, which is a continuation of application Ser. No. 06/896,069 filed Aug. 13, 1986, now abandoned.

BACKGROUND OF THE INVENTION

1. Field of the Invention

The present invention relates to a speech recognition apparatus for recognizing speech information inputs.

2. Related Background Art

A conventional speech recognition apparatus of this type sequentially matches speech inputs and prestored reference or standard speech patterns, measures distances therebetween, and extracts standard patterns having minimum distances as speech recognition results. For this reason, if the number of possible recognition words is increased, the number of words prestored in the memory is increased, recognition time is prolonged, and the speech recognition rate is decreased. These are typical drawbacks in a conventional speech recognition apparatus.

In order to solve these problems, another conventional scheme is proposed wherein standard speech patterns are registered in units of words, numerals, or phonemes. At the time of speech recognition, a word group memory for storing these standard unit patterns can be selected to perform strict matching between the standard patterns stored therein and the speech input. A method of selecting and changing the word group memory utilizes key or speech inputs. The method utilizing key inputs allows accurate selection and changing of the word group memory. However, this method requires both key and speech inputs, resulting in a complicated operation which overloads the operator.

On the other hand, the method utilizing speech inputs requires a command for selecting and changing the memory for storing the standard speech patterns as well as a command for selecting and changing the desired speech pattern. Therefore, a separate memory for storing index patterns representing the respective word group memories is required.

More specifically, original speech patterns are divided and stored in several word group memories according to the features of the words constituting the speech patterns. A change command such as "change" is stored in each memory. If selection or change of the word group memory is required, a speech input "change" is entered. This speech input is detected by the currently selected word group memory, thereby selecting the word group memories to be replaced. Subsequently, another speech input representing the name of the desired word group memory is entered to select the desired word group, i.e., the desired speech pattern. According to this conventional method, two speech inputs are required to select the desired speech pattern, resulting in a time-consuming operation.

In addition, since the speech patterns designated by the change command are stored in the respective word group memories, speech patterns having different peak levels and different utterance lengths of time are stored in the respective word group memories even if the identical words are stored therein. Even if identical selections or changes are performed, the recognition results may be different. In the worst case, the word group memory to be replaced cannot be set.

In a conventional speech recognition apparatus, a speech input is A/D converted to a digital signal and this signal is sent to a feature (characteristic) extraction unit. The feature extraction unit calculates speech power information and spectral information of the speech input according to a technique such as a high-speed Fourier transform.

The number of standard patterns stored in a standard pattern memory unit is equal to that of types of information calculated by the feature extraction unit. Similarities between the patterns in pattern matching are calculated between the speech input and the standard pattern of the same type, and the final similarity is derived by adding products obtained by multiplying a predetermined coefficient with the resultant information signals.

In a conventional speech recognition apparatus, the distinctions between voiced and unvoiced sounds, between silence and voiceless consonants in the unvoiced sounds, between vowels and nasal sounds in voiced sounds, and the like are made by utilizing speech power information or by dividing the frequency band into low, middle, and high frequency ranges and comparing frequency component ratios included in the frequency bands.

However, if noise is mixed in the speech input, consonant power information at the beginning of a word often cannot be detected because of the presence of the noise. Even a consonant within a word, but not at the start or end position of the word, often cannot be easily detected since the steady consonant power information is combined with the spectral power of a vowel before and/or after the consonant.

In addition, the spectral characteristics of vowel /u/ are very similar to those of nasal consonants /m/ and /n/ and are often erroneously detected thereas.

SUMMARY OF THE INVENTION

It is an object of the present invention, in consideration of the above situation, to provide a new and improved speech recognition apparatus.

It is another object of the present invention to provide a speech recognition apparatus wherein speech recognition is performed at high speed according to utterance time information of a speech input at a high speech recognition rate.

It is still another object of the present invention to provide a speech recognition apparatus such as a compact speech typewriter or wordprocessor wherein standard speech patterns are recorded in a magnetic or IC card and can be easily read out to allow easy maintenance and control.

It is still another object of the present invention to provide a speech recognition apparatus wherein speech length variation information is added to speech feature information or peak value information, thereby improving the speech recognition rate.

It is still another object of the present invention to provide a speech recognition apparatus wherein the speech length variation information allows exclusive selection of matching candidates to shorten the total speech recognition time.

It is still another object of the present invention to provide a speech recognition apparatus comprising a speech pattern storage means for storing a plurality of standard speech patterns grouped according to utterance lengths, a speech input means for inputting speech information, utterance length detecting means for detecting an utterance length of a speech input entered by the speech input means, speech pattern readout means for reading out a corresponding standard speech pattern from the speech pattern storage means according to the utterance length detected by the utterance length detecting means, and speech recognizing means for sequentially comparing the standard speech patterns read out by the speech pattern readout means with patterns of the speech input and for recognizing the speech input.

It is still another object of the present invention to provide a speech recognition apparatus wherein information on a peak value of a speech input is used in a speech recognition scheme to exclusively select recognition groups as the speech recognition object of interest, and wherein information on the peak value is included in the standard patterns to shorten the matching time at a high recognition rate.

It is still another object of the present invention to provide a speech recognition apparatus comprising a detecting means for detecting the peak level of speech information to detect a variation over time in peak level, and preliminary selecting means for preliminarily selecting recognition candidates corresponding to speech information according to the features of the speech information peak value detected by the detecting means.

It is still another object of the present invention to provide a speech recognition apparatus wherein certain recognition candidates are selected for input speech information and then recognition results are selected from the recognition candidates.

It is still another object of the present invention to provide a speech recognition apparatus wherein utterance time information of the speech input is used in a speech recognition scheme to write the speech patterns in a speech pattern storage means at high speed and to shorten the speech recognition matching time at a high recognition rate.

It is still another object of the present invention to provide a speech recognition apparatus wherein changes over time in peak levels of the input speech information are combined with the features of the speech information to output optimal recognition results.

It is still another object of the present invention to provide a speech recognition apparatus comprising first operation means for calculating the peak level of a waveform of the speech information, second operation means for calculating changes over time in the peak level calculated by the first operation means, and combining means for combining the changes over time in the peak level calculated by the second operation means with the features of speech information.

DETAILED DESCRIPTION OF THE PREFERRED EMBODIMENTS

Preferred embodiments of the present invention will be described in detail with reference to the accompanying drawings.

Figure 1:
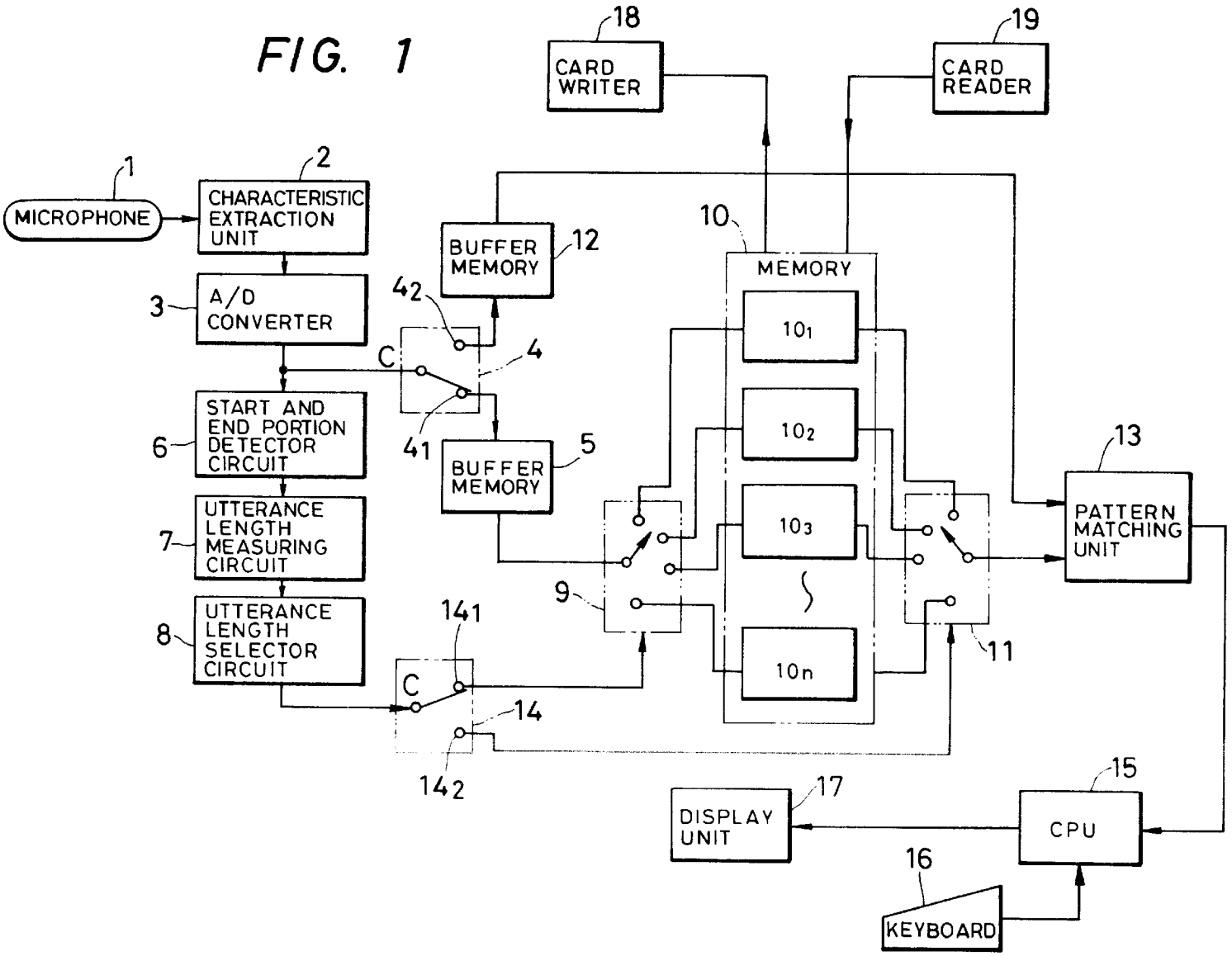
FIG. 1 is a block diagram of a speech recognition apparatus according to an embodiment of the present invention.

FIG. 1 is a block diagram of a speech recognition apparatus according to an embodiment of the present invention.

Referring to FIG. 1, the speech recognition apparatus includes a microphone 1 for converting speech into an electrical signal, a feature or characteristic extraction unit 2 consisting of band-pass filters providing 8 to 30 channels for a frequency band of 200 to 6,000 Hz so as to perform feature extraction for extracting a power or format frequency signal, and an A/D converter 3 for sampling and quantizing features from the feature extraction unit 2 in units of 5 to 10 ms. The speech recognition apparatus also includes registration/recognition switching means 4 and 14 for switching between the standard speech registration and input speech recognition modes, buffer memories 5 and 12 for storing input speech feature parameters until the input speech utterance lengths of time are calculated in the registration or recognition mode, and a start and end portion detector circuit 6 for detecting a point corresponding to the start or end portion of the words from the power signal of the speech input.

The speech recognition apparatus further includes an utterance length measuring circuit 7, an utterance length selector circuit 8, a memory 10, switches 9 and 11, a pattern matching unit 13, a CPU (Central Processing Unit) 15, a keyboard 16, a display unit 17, a card writer 18, and a card reader 19. The utterance length measuring circuit 7 measures the utterance length of time from the start to the end portions of the speech input according to detection point data from the start and end portion detector circuit 6. The utterance length selector circuit 8 generates a selection signal for word group memory units $\mathbf{10}_1$ to $\mathbf{10}_n$ according to the utterance time detected by the utterance length measuring circuit 7. The switch 9 selects one of the word group memory units $\mathbf{10}_1$ to $\mathbf{10}_n$ in the speech registration mode. The switch 11 selects one of the word group memory units $\mathbf{10}_1$ to $\mathbf{10}_n$ in the speech recognition mode. The pattern matching unit 13 compares the input speech pattern with the registered speech pattern selectively read out from the word group memory units $\mathbf{10}_1$ to $\mathbf{10}_n$ in the speech recognition mode. The CPU 15 processes the recognition results. The display unit 17 displays the processed recognition results. The card writer 18 reads out the standard speech patterns from the memory 10 and stores them on a recording card. The card reader 19 loads the standard speech patterns from the recording card to the memory 10.

In this embodiment, magnetic cards are used as recording cards. The magnetic cards are small as compared with a magnetic flexible disk unit and can be easily and conveniently handled. Optical or IC cards may be used in place of the magnetic cards.

The operation of the speech recognition apparatus having the arrangement described above will be described below.

The utterance length of time of speech input from the microphone 1 is calculated by the time difference between the start and end portions of the speech input. Various techniques may be proposed to detect the start and end portions of the speech input. In this embodiment, the speech input is converted by the A/D converter 3 into a digital signal representing the power of the speech input, and the power is used to detect the start and end portions of the speech input.

Figure 2:
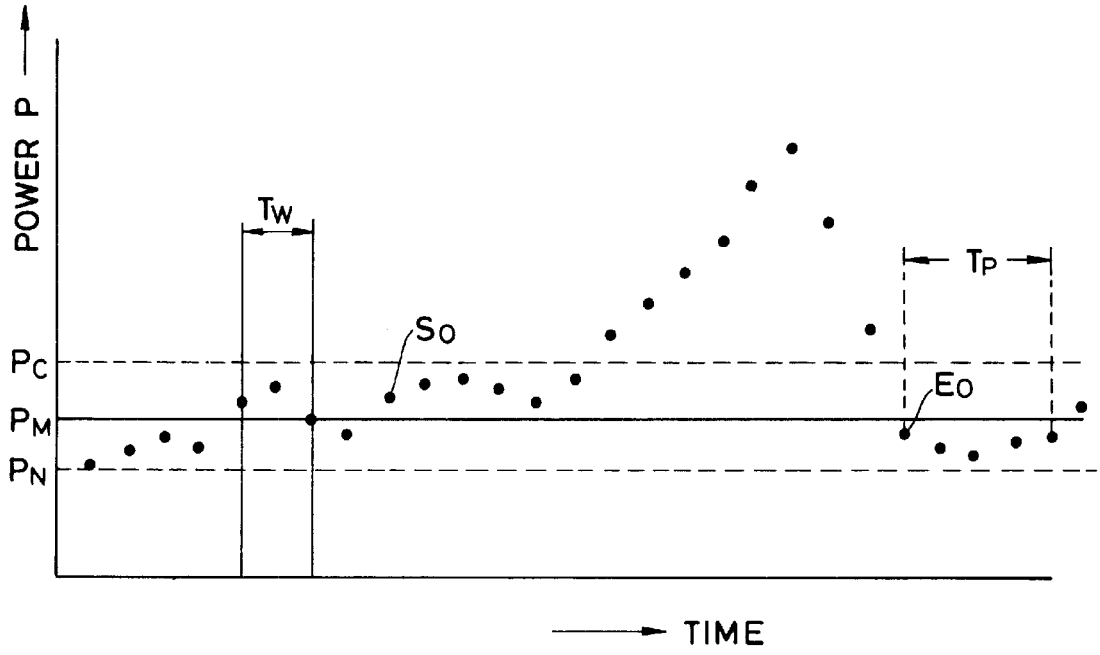
FIG. 2 is a graph showing input speech power information P as a function of time in the speech recognition apparatus of FIG. 1.

FIG. 2 shows power data P of the digital signals output for every 5 to 10 ms from the A/D converter 3. The power data P is plotted along the ordinate, and time is plotted along the abscissa.

Referring to FIG. 2, the average value of noise power is calculated in advance in a laboratory and is defined as a threshold value $P_N$. In addition, a threshold value of a consonant which tends to be pronounced as a voiceless consonant at the beginning of a word or which has a low power at the beginning of the word is defined as $P_C$. The average value of these threshold values $P_N$ and $P_C$ is defined as $P_M$. A minimum pause time between adjacent two speech inputs is defined as $T_p$, and a minimum utterance time recognized as a speech input is defined as $T_w$.

Detection of Start Portion $S_0$

The first point of power signals output for every 5 to 10 ms from the A/D converter 3 and satisfying condition $P \geqq P_M$ is detected. If a state satisfying condition $P \geqq P_M$ continues for the time $T_W$ or longer after this point, the first point satisfying condition $P \geqq P_M$ is defined as the start portion $S_0$. However, if the state satisfying condition $P \geqq P_M$ is ended within the time $T_W$, the input signal is disregarded as noise. The next point satisfying condition $P \geqq P_M$ is found, and the above operation is repeated.

Detection of End Portion $E_0$

The first point of the power signals P, which satisfies condition $P<P_M$, is detected after detection of the start portion $S_0$. If a state satisfying condition $P<P_M$ continues for the time $T_P$ or longer after this point, the first point satisfying condition $P<P_M$ is defined as the end portion $E_0$. In this manner, the start and end portions of the speech input are detected.

When the start and end portion detector circuit 6 detects the start portion $S_0$, the utterance length measuring circuit 7 causes a timer to start. The timer is stopped upon detection of the end portion $E_0$. Therefore, the utterance length measuring circuit 7 calculates an utterance length of time. This measured length data is supplied to the utterance length selector circuit 8.

Figure 3:
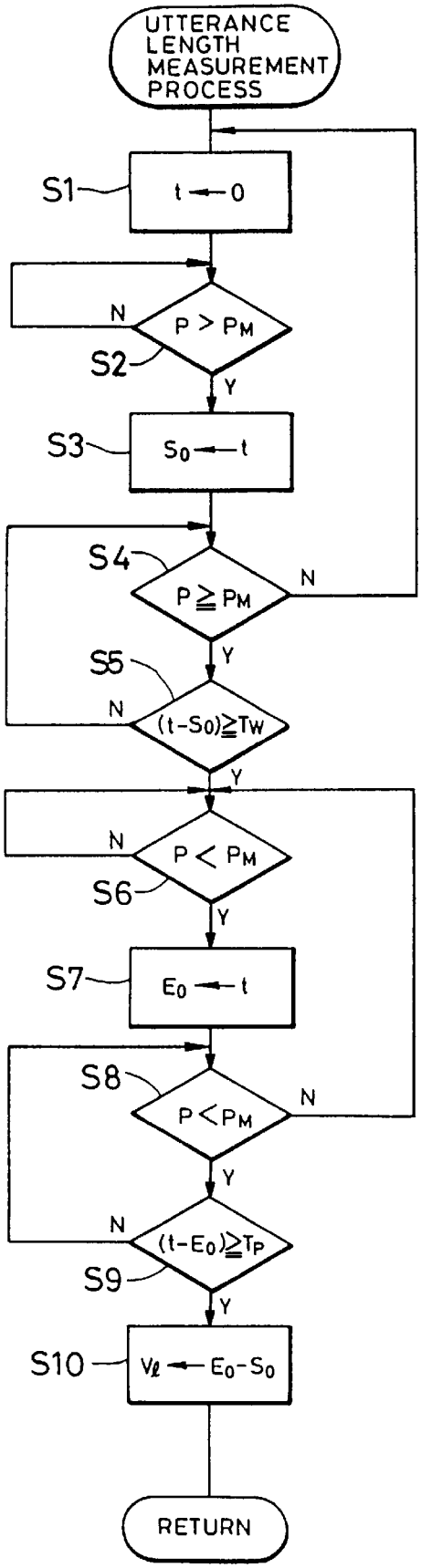
FIG. 3 is a flow chart showing utterance length measurement processing in the apparatus of FIG. 1.

The above operation can be achieved by a microprocessor incorporating a control program in FIG. 3.

Utterance time detection control will be described in detail with reference to a flow chart in FIG. 3.

In step S1, the CPU 15 initializes a timer t to be "0". In step S2, the CPU 15 waits until the power signal P exceeds $P_M$. If YES in step S2, the flow advances to step S3. At this time, the current count of the timer t is stored in a start portion register $S_0$. In steps S4 and S5, the CPU 15 waits until the state satisfying condition $P \geqq P_M$ continues for the time $T_W$ or longer. If the state satisfying condition $P \geqq P_M$ does not continue for the time $T_W$ the flow returns to step S1. In this case, the input signal P is regarded as noise.

If the state satisfying condition $P \geqq P_M$ continues for the time $T_W$ or longer, the flow advances to step S6 and the content of the start portion register $S_0$ is affirmed. The CPU 15 then waits for a state satisfying condition $P<P_M$. When YES in step S6, the current count of the timer t is stored in an end portion register $E_0$ in step S7. The CPU 15 waits in steps S8 and S9 to determine whether the state satisfying condition $P<P_M$ continues for the time $T_P$ or longer. If NO in step 8 or 9, the flow returns to step S6. The current power signal P is detected as a valid signal, and the speech input is detected as a succeeding input. If the state satisfying condition $P<P_M$ continues for the time $T_P$ or longer, the flow advances to step S10. In step S10, the CPU 15 determines that the input signal represents an end portion of the speech input, and confirms the content of the end portion register $E_0$, so that the interval between time $S_0$ to time $E_0$ is determined to be an utterance length V1. In this manner, the utterance length of the speech input is measured according to the above-mentioned processing.

The memory map of the memory 10 for storing standard speech patterns will be described. The detailed allocation of the memory 10 in this embodiment is summarized in the following table.

TABLE

| Word Group Memory Unit | Utterance Time ($T_W$) |
|---|---|
| $10_1$ | $0.4S \leqq T_W < 0.6S$ |
| $10_2$ | $0.6S \leqq T_W < 0.8S$ |
| $10_3$ | $0.8S \leqq T_W < 1.0S$ |
| $10_4$ | $1.0S \leqq T_W < 1.2S$ |
| . | . |
| . | . |
| . | . |
| $10_{10}$ | $2.4S \leqq T_W < 2.6S$ |
| $10_{11}$ | $2.6S \leqq T_W < 2.8S$ |
| $10_{12}$ | $2.8S \leqq T_W < 3.0S$ |

The memory 10 consists of word group memory units $\mathbf{10}_1$ to $\mathbf{10}_n$ for storing the word groups in units of utterance lengths of time. Utterance lengths of time of the words fall within the range of 0.4S to 3S, as shown in the above table. The word group memory units $\mathbf{10}_1$ to $\mathbf{10}_n$ store word groups whose utterance length starts from 0.4S and is incremented in units of 0.2S.

In the standard speech registration mode, contacts c of the switches 4 and 14 are respectively connected to contacts $\mathbf{4}_1$ and $\mathbf{14}_1$ as shown in FIG. 1. A speech signal input from the microphone 1 which is to be registered is set in the buffer memory 5 through the feature extraction unit 2 and the A/D converter 3 under the control of the CPU 15. At the same time, the output from the A/D converter 3 is also supplied to the start and end portion detector circuit 6. An output from the detector circuit 6 is supplied to the utterance length detector circuit 7. The utterance length V1 of the speech input which is detected by the utterance length detector circuit 7 is sent to the utterance length selector circuit 8. The utterance V1 is then converted by the selector circuit 8 into a selection signal for selecting one of the word group memory units $\mathbf{10}_1$ to $\mathbf{10}_n$. The selection signal is sent to the word group memory registration switch 9 through the contact $\mathbf{14}_1$ of the switch 14 so that the corresponding word group memory unit can be selected. A speech feature pattern (e.g., a portion from $S_0$ to $E_0$) stored in the buffer memory 5 is stored as the standard pattern in the selected word group memory unit. In this manner, speech patterns having different utterance lengths are stored in the corresponding word group memory units for storing the patterns in units of utterance lengths.

The standard speech patterns registered by each operator are sent to the card writer 18 and stored therein. For the subsequent use of the speech recognition apparatus, the operator uses the card reader 19 to load his own standard speech patterns from the recording cards to the respective word group memory units in the memory 10, thereby omitting new registration of the standard speech patterns.

In the speech recognition mode, the contacts c of the switches 4 and 14 in FIG. 1 are respectively connected to contacts $\mathbf{4}_2$ and $\mathbf{14}_2$, so that the output from the A/D converter 3 is set in the buffer memory 12. The selection signal from the utterance length selector circuit 8 is sent to the word group memory unit recognition switch 11 through the contact $14_2$ of the switch 14, and the word group memory unit corresponding to the detected utterance length V1 is selected. Subsequently, the standard patterns of the selected word group memory unit are sent to the pattern matching unit 13 one by one. Each standard pattern is matched by the pattern matching unit 13 with the input speech feature pattern stored in the buffer memory 12. The standard pattern is selected, and a corresponding code is sent as a recognition result to the CPU 15.

The above operation will be described in more detail below.

Assume that a word A is input, that its feature parameter is stored in the buffer memory 5, and that an utterance length of time is calculated to be 0.85S by the start and end portion detector circuit 6 and the utterance length measuring circuit 7. The utterance length selector circuit 8 selects the word group memory unit $10_3$ in response to time data of 0.85S according to the table described above. The feature pattern of the word A in the buffer memory 5 is stored in the memory unit 10 In the speech recognition mode, the memory unit $10_3$ is selected by the switch 11 according an operation similar to that described above. The feature pattern of the word A is sequentially matched with standard patterns from the memory unit $10_3$.

If the utterance time of a given word in the standard pattern registration mode is different from that in the speech recognition mode, the desired word group memory unit cannot often be selected in the speech recognition mode. For example, if a word B has an utterance length of 0.795S in the speech recognition mode and the word B has an utterance length of 0.8S in the registration mode, the word B is registered in the memory unit $10_2$. However, recognition matching is performed between the word B and the standard pattern in the memory unit $10_3$. As a result, the word B cannot be recognized. In order to solve the problem of utterance length variations in this embodiment, the suitable word group memory unit is selected by utterance time data as a combination of the true utterance length in the recognition mode and a predetermined variation width. For example, if a variation width of ±0.01 S is added to the true utterance length of 0.8S of the word B in the recognition mode, the resultant utterance length of the word B can fall within the range of 0.799S to 0.801S. This range includes the data in both the memory units $10_2$ and $10_3$. Therefore, matching between the word B and the standard patterns in the memory unit $10_2$ and matching between the word B and the standard patterns in the memory unit $10_3$ are performed.

On the other hand, if the utterance length of a word C in the registration mode is 1.05 S and the true utterance length in the recognition mode is 1.10S, the utterance length in the recognition mode combined with the variation of +0.01S falls within the word group of the memory unit $10_4$ in the registration mode. In this case, therefore, only pattern matching between the word C and the patterns in the memory unit $10_4$ is performed. According to this embodiment, there is provided a speech recognition apparatus capable of compensating for utterance length variations.

When 500 words were recognized by the speech recognition apparatus of this embodiment and the recognition time were compared with a conventional apparatus under the same conditions as in this embodiment, the total recognition time was shortened by 100 ms to 500 ms and the recognition rate was improved by 20% or more. As a result, an average recognition processing time was 280 ms and the recognition rate was 98.5%.

In this embodiment, $P_N$ is defined by dark noise in the laboratory. However, the value of $P_N$ may vary under any arbitrary noise atmosphere according to the actual application of the speech recognition apparatus. The number of word group memory units, the capacity of the memory consisting of the word group memory units, the utterance time width, and the variations in utterance lengths in the recognition mode may vary so as to obtain optimal recognition results.

This embodiment is applicable to a typewriter to obtain a high-speed speech typewriter with high reliability.

In the above embodiment, the card writer 18 and the card reader 19 are represented by a magnetic card writer and reader, respectively. However, a semiconductor memory (RAM) pack incorporating a backup power source (battery) may be used, and the standard speech patterns of the memory 10 may be stored in the RAM pack. With this arrangement, the read/write time can be shortened and the external memory device can be made compact.

In addition, a large-capacity magnetic bubble card or an optical card may be used as the recording card.

According to the embodiment described above, there is provided a speech recognition apparatus wherein the utterance time data is added to the speech feature data to shorten the speech recognition time in the recognition mode. More specifically, a smaller number of pattern matching candidates are selected in the speech recognition mode according to the utterance time data. Even if the number of words to be registered is large, the total recognition processing time can be shortened. The utterance time data is also regarded as significant data for speech recognition. Therefore, the use of the utterance time data in the speech recognition mode increases the recognition rate.

The standard speech patterns may be stored in recording cards or the like to achieve compact, simple data storage, as compared with data storage with a floppy disk or the like, thereby enabling each user to save customized standard speech patterns. As a result, one speech recognition apparatus can be commonly used by many users. In addition, the standard speech patterns can be simply read out at high speed.

According to this embodiment, there is provided a speech recognition apparatus which can be easily handled and has a high recognition rate. In addition, if the speech recognition apparatus is widely used as an industrial devices, numerous other practical advantages can be obtained.

Another Embodiment

Another embodiment of the present invention will be described with reference to the accompanying drawings below.

Figure 4:
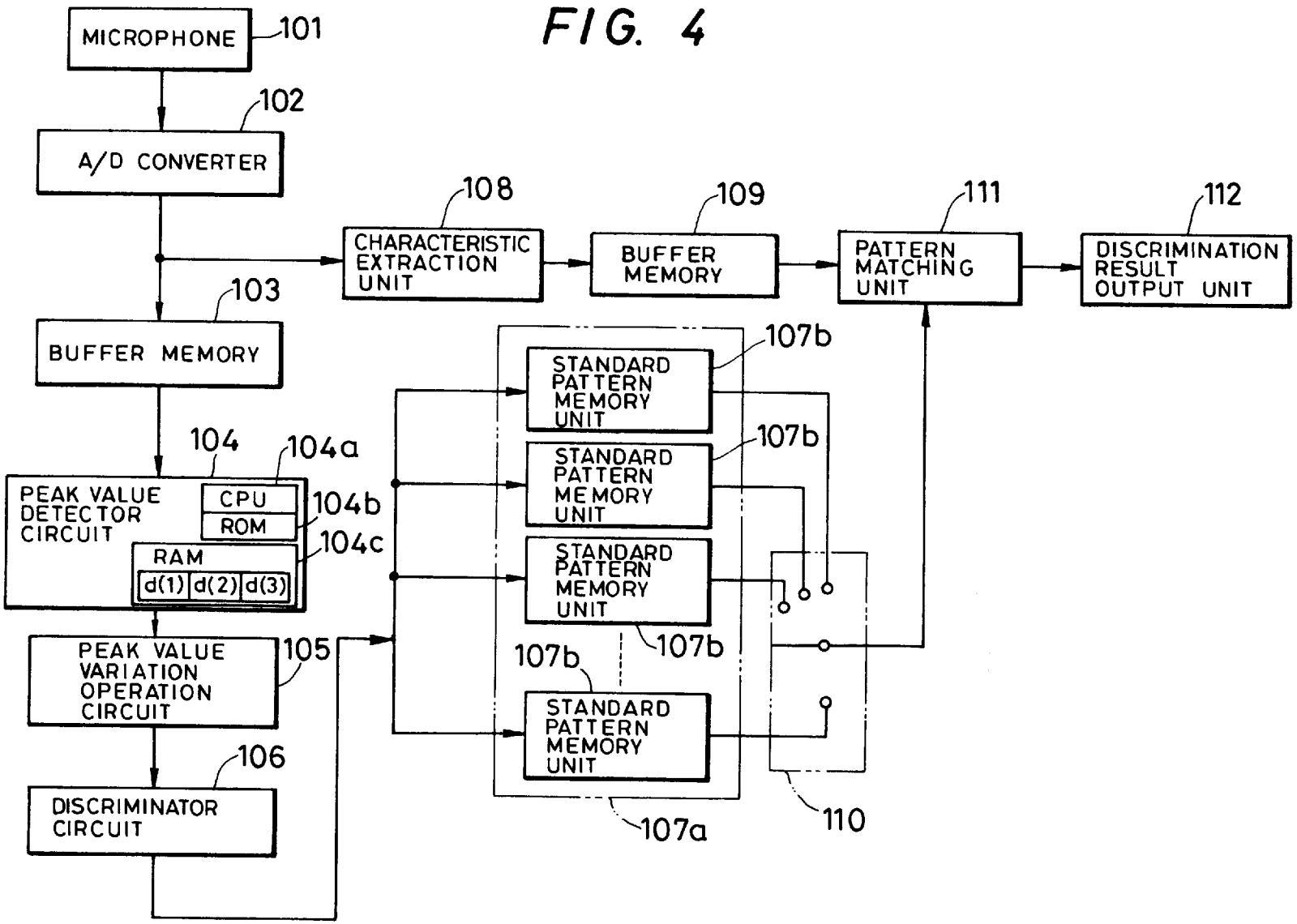
FIG. 4 is a block diagram of a speech recognition apparatus according to another embodiment of the present invention.

FIG. 4 is a block diagram of a speech recognition apparatus of this embodiment. The speech recognition apparatus includes a microphone 101, an A/D converter 102, a buffer memory 103, and a peak value detector circuit 104. The microphone 101 serves as a speech input unit for converting speech into an electrical signal. The A/D converter 102 samples analog speech input every 5 to 10 ms and quantizes the analog signal into a digital signal. The buffer memory 103 temporarily stores an output from A/D converter 102. The peak value detector circuit 104 sequentially reads out data from the buffer memory 103 and calculates peak values. The peak value detector circuit 104 includes a CPU (Central Processing Unit) 104*a*, a ROM 104*b* for storing a program of a flow chart in FIG. 6, and a RAM 104*c* serving as a work area and for storing buffers d(1), d(2), and d(3) used for calculating peak values to be described later. The speech recognition apparatus also includes a peak value variation operation circuit 105, a discriminator circuit 106, and a memory 107*a*. The peak value variation operation circuit 105 calculates a peak value variation as a function of time. The discriminator circuit 106 discriminates a speech input (in the form of the peak value calculated by the peak value variation operation circuit 105) as a voiced or voiceless sound. The discriminator circuit 106 also discriminates silence from voiceless consonants, and vowels from the nasal consonants. The memory 107*a* consists of standard pattern memory units 107*b* for storing the standard patterns in units of peak values. The speech recognition apparatus further includes a feature or characteristic extraction unit 108, a buffer memory 109, a switch 110, a pattern matching unit 111, and a discrimination result output unit 112. The characteristic extraction unit 108 consists of band-pass filters having 8 to 30 channels obtained by dividing a frequency range of 200 to 6,000 Hz. The characteristic extraction unit 108 extracts feature data such as a power signal and spectral data. The buffer memory 109 temporarily stores input speech feature data until a suitable standard pattern memory unit is selected. The switch 110 selects one of the standard pattern memory units 107*b*, which is discriminated by the discriminator circuit 106. The pattern matching unit 111 causes the input speech feature data switch 110 to operate to compare the input feature data with the readout standard pattern so as to calculate a similarity therebetween. The discrimination result output unit 112 outputs, as the recognition result, the standard pattern having the maximum similarity to the input feature data. This similarity is calculated by the pattern matching unit 111.

The operation of the speech recognition apparatus will be described in detail hereinafter.

The speech input is converted by the A/D converter 102 to a digital signal. The digital signal is sent to the peak value detector circuit 104 and the characteristic extraction unit 108 through the buffer memory 103. The sampling frequency of the A/D converter 102 and the number of quantized bits for each sample are variable. However, in this embodiment, the sampling frequency is 12 kHz, and each sample comprises 12 bits (one of the 12 bits is a sign bit). In this case, a one-second speech input is represented by 12,000 bits of data.

Figure 5:
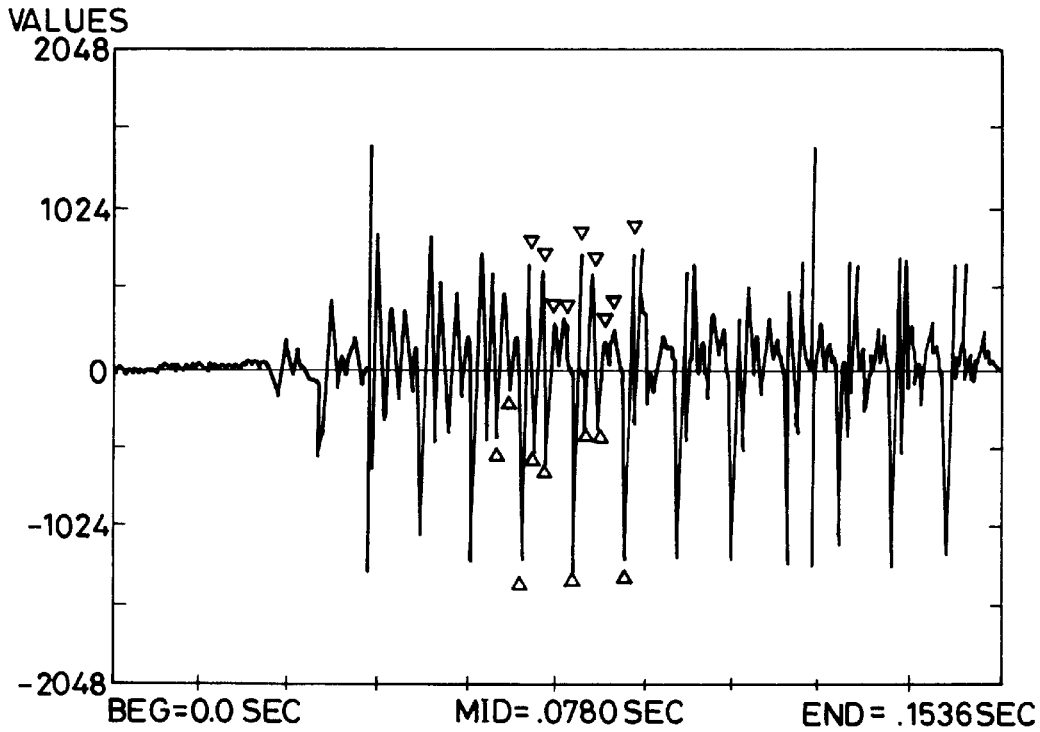
FIG. 5 is a-chart showing A/D converted output data of the speech input.

FIG. 5 is a graph showing outputs from the A/D converter 2.

A/D conversion is performed on a real-time basis. For this reason, the buffer memory 103 is arranged in front of the peak value detector circuit 104. The peak value detector circuit 104 sequentially reads out the sampled data from the buffer memory 103.

Figure 6:
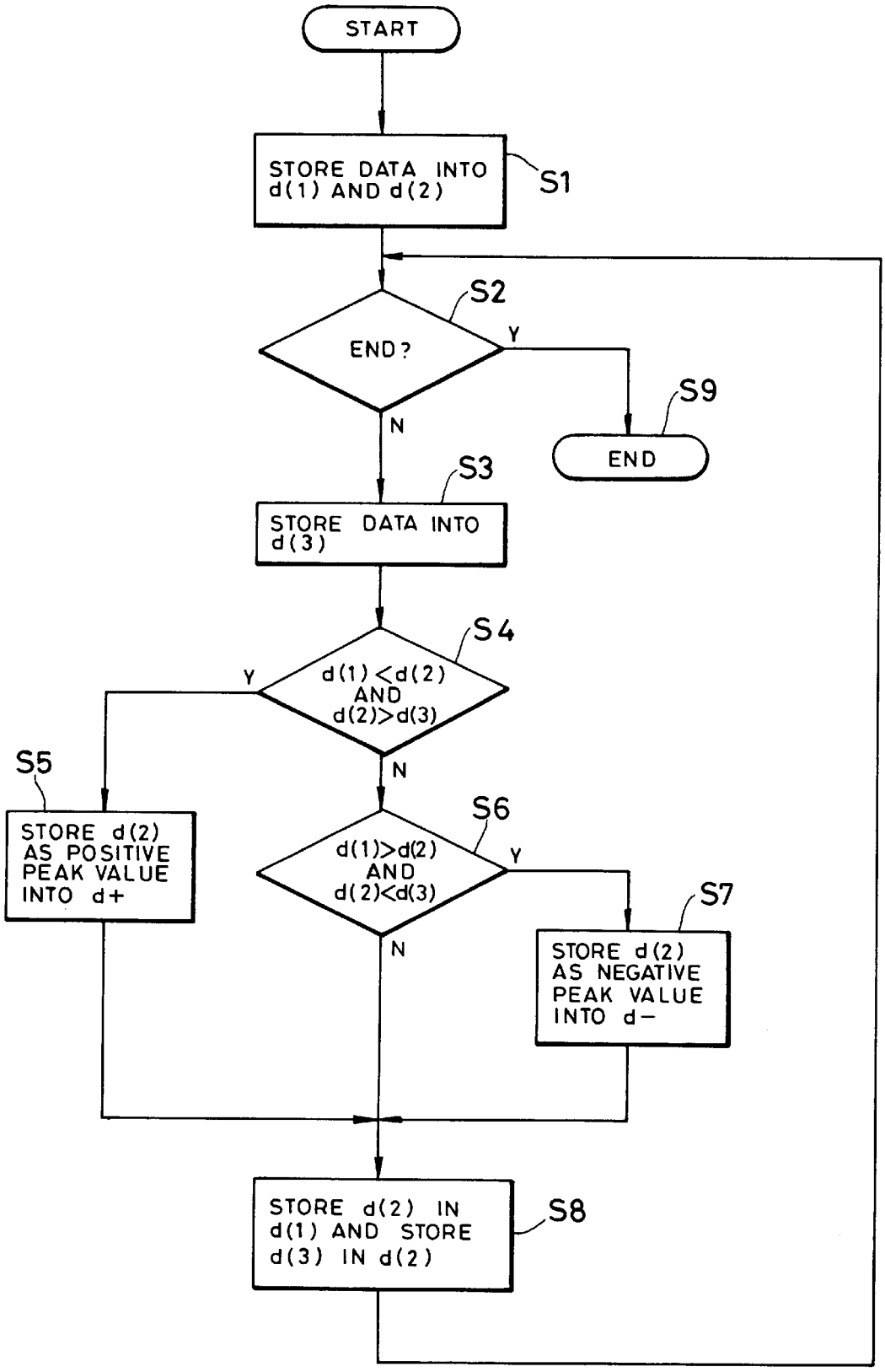
FIG. 6 is a flow chart for explaining peak value detection processing in the apparatus in FIG. 4 and FIG. 7.

FIG. 6 is a flow chart for explaining the operation of the CPU 104*a* in the peak value detector circuit 104.

Data from the buffer memory 103 is selectively stored in the registers d(1), d(2) and d(3) of the RAM 104*c*. Numerals in paretheses denote sampled data numbers. Reference symbol d+ denotes a positive peak value; and d−, a negative peak value.

Referring to FIG. 6, in step S1, the first two data signals are read out from the buffer memory 103 and stored in the registers d(1) and d(2), respectively. The CPU 104*a* determines in step S2 whether all data in the buffer memory 103 is read out. If YES in step S2, processing is ended in step S9. However, if NO in step S2, the flow advances to step S3. The next data is read out from the buffer memory 103 and stored in the register d(3).

The registers d(1), d(2), and d(3) are compared in steps S4 and S6. For example, if d(1)<d(2), d(2)>d(3), and d(2)>0, then d(2) represents a positive peak value; If d(1)>d(2), d(2)<d(3), and d(2)<0, then d(2) represents a negative peak value. When one of the above conditions is satisfied, d(2) is stored in either d+ or d− in step S5 or S7 respectively. Data representing the order of the stored data is stored, and the flow advances to step S8.

However, if neither of the above conditions is satisfied, the flow advances directly to step S8. In step S8, the current d(2) is stored in d(1), and similarly d(3) is stored in d(2). The flow advances to step S2 to check whether all data from the buffer memory 103 is read out. If YES in step S2, the flow advances to step S9 and processing is ended. If NO in step S2, new data is read out from the buffer memory 103 and stored in d(3). The above operation is then repeated to complete all data procesisng.

The amount of data is a value obtained by multiplying the measurement time with 12,000.

In order to calculate the peak value, the following operation will be performed.

Description for Calculating Positive Peak Value

If d(1)≦d(2), then d(2) and d(3) are compared. If d(3)<d(2), then 2 is a peak so that the value of d(2) is a peak value. The sign of d(2) is checked to determine whether it is a positive value. If d(2)>0, d(2) is stored into d+. The values d+ and n are stored, and the operations in step S8 and subsequent steps are performed.

Otherwise, e.g., if d(3)≧d(2) and d(2)≦0, then the operations in step S8 and the subsequent steps are performed.

Description for Calculating Negative Peak Value

If d(1)≧d(2), d(2) and d(3) are further compared.

If d(3)>d(2), 2 is a peak so that the value of d(2) is a peak value. The sign of d(2) is checked to determine if d(2) is a negative value. If d(2)<0, d(2) is stored into d−. The values of d− and n are saved, and the operations in step S8 and the subsequent steps are performed.

Otherwise, e.g., if d(3)≧d(2) and d(2)≦0, the operations in step S8 and the subsequent steps are directly performed.

Referring to FIG. 5, the positions of the positive and negative peak values d+ and d− obtained by the peak value detector circuit 104 are represented by symbols ▽ and ▲.

The peak value variation operation circuit 105 calculates the following feature parameters according to an output from the peak value detector circuit 104, and terms d+(n) and d−(n) in the mathematical expressions respectively represent a combination of time data n and peak value data d+ and a combination of time data n and peak value data d−:

Feature Parameters

Ratio of Sum of Positive Peak Values to Sum of Negative Peak Values Within Predetermined Period of Time:

$$p1=\Sigma\{d+(n);n\leqq T\}/\Sigma\{d-(n);n\leqq T\}$$

Ratios of Adjacent Peak Values of Identical Sign and Their Distances:

$$p2=d+(n-1)/d+(n)$$

$$p2(n,t)=\{\text{time for } n \text{ in } d+(n)\}-\{\text{time for } n-1 \text{ in } d+(n-1)\}$$

and $$p3=|d-(n-1)|/|d-(n)|$$

$$p3(n,t)=\{\text{time for } n \text{ in } d-(n)\}-\{\text{time for } n-1 \text{ in } d-(n-1)\}$$

Ratios of Adjacent Peak Values of Different Signs and Their Distances:

$$p4(n,+)=d+(n-1)/|d-(n)|$$

$$p4(n,t)=\{\text{time for } n \text{ in } d+(n)\}-\{\text{time for } n-1 \text{ in } d-(n-1)\}$$

and $$p5(n,-)=|d-(n-1)|/d+(n)$$

$$p5(n,t)=\{\text{time for } n \text{ in } d+(n)\}-\{\text{time for } n-1 \text{ in } d-(n-1)\}$$

The discriminator circuit 106 combines the magnitude of the peak value and the feature parameters calculated by the peak value variation operation circuit 105, and discriminates the voiced sounds from voiceless sounds, the silence from the voiceless consonants, and vowels from nasal sounds in voiceless sounds.

In the above embodiment, the speech input is sampled at a frequency of 12 kHz. The standard patterns stored in the standard pattern memory units 7*b* are selected according to the following standards:

1) Discriminating Between Voiced Sound And Voiceless Sound

If a difference between the values of d+(n) and d−(n) is 100 ms or more, and condition p4(n,+)>1.3 or p5(n,−)>0.76 is satisfied, the speech input is discriminated as a voiced sound. Otherwise, the speech input is determined to be a voiceless sound.

2) Discriminating Between Silence and Voiceless Consonant

Among the speech inputs discriminated as voiceless sounds in standard (1), if condition p2(n,t)<3 or p3(n,t)<3 is satisfied, the speech input is discriminated as silence. Otherwise, the speech input is discriminated as a voiceless consonant.

3) Discriminating Between Vowel And Consonant

Among the speech inputs discriminated as voiced sounds in standard (1), if p1 >1.5, then the speech input is discriminated as a vowel. Otherwise, the speech input is discriminated as a consonant.

The candidates of the standard patterns selected according to standards (1) to (3) are stored in the standard pattern memory units 107*b*. One of the standard pattern memory units 107*b* is selected. This selection is performed by the switch 110 in FIG. 4. The standard patterns are sequentially read out from the selected standard pattern memory unit 107*b* and are supplied to the pattern matching unit 111. The feature patterns of the speech input, which are output from the characteristic extraction unit 108 and temporarily stored in the buffer memory 109, are supplied to the pattern matching unit 111. The pattern matching unit 111 calculates similarities between the readout standard patterns and the input feature patterns. The standard pattern having a maximum similarity to the input feature pattern is selected as a recognition result. The recognition result is output from the discrimination result output unit 112.

According to this embodiment, as described above in detail, several candidates of the speech input are selected to output an accurate recognition result.

In this embodiment, a group of the standard patterns is selected in response to the peak value variation data. However, the peak value variation data may be combined with the feature parameter of the respective standard patterns to obtain the same effect as in the above embodiment without grouping the standard pattern memory units. Time variation data may be replaced with spectral envelope data or zero tolerance data. This embodiment is a high-speed speech recognition apparatus with high precision, and can be implemented in apparatus such as a typewriter with a speech recognition function.

In the above embodiment, the speech input is sampled at the frequency of 12 kHz. However, the sampling frequency is not limited to 12 kHz. In the above embodiment, one sample consists of 12 bits. However, the number-of bits is not limited to 12.

Another Embodiment

A speech recognition apparatus according to still another embodiment of the present inveniton will be described with reference to the accompanying drawings.

Figure 7:
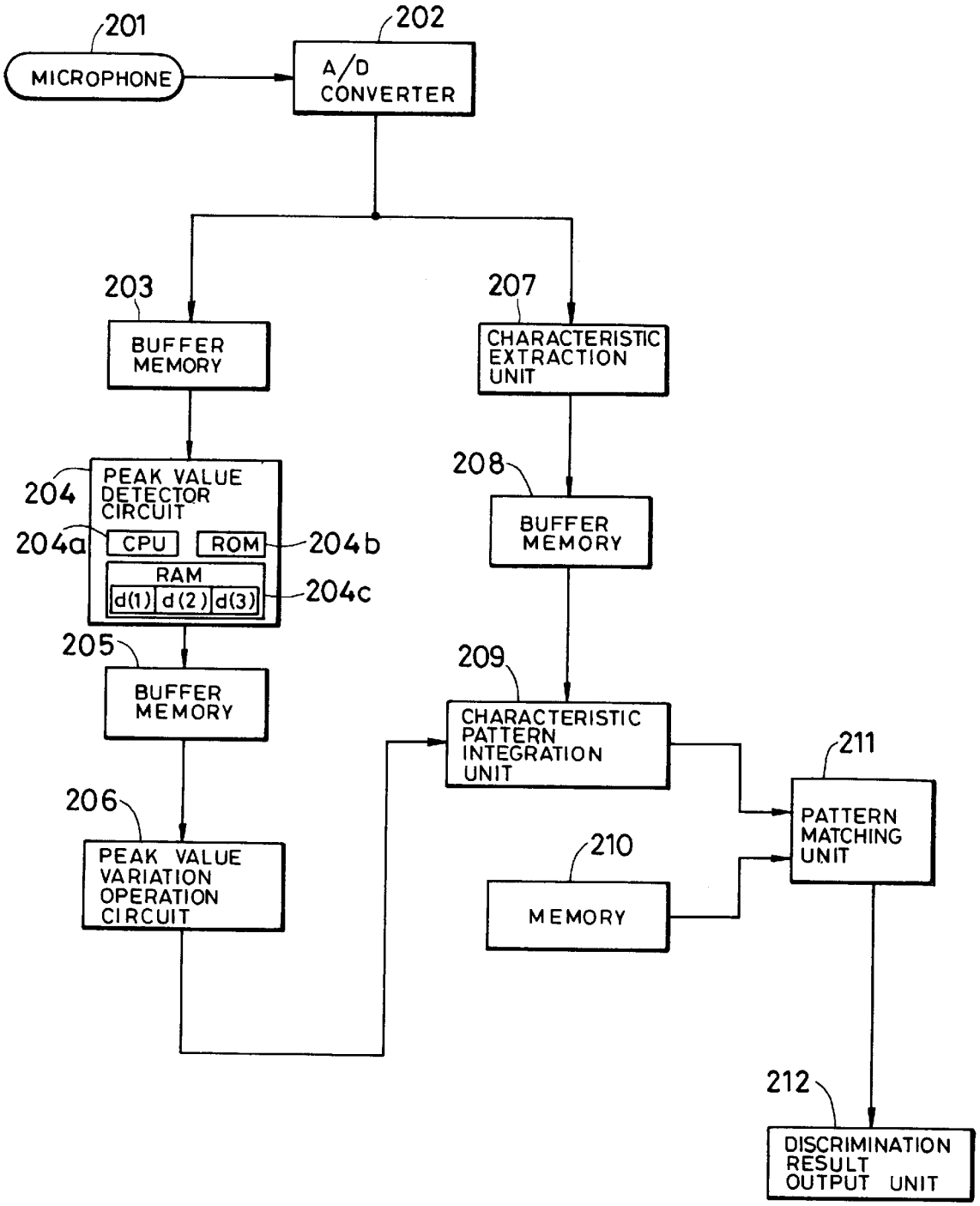
FIG. 7 is a block diagram of a speech recognition apparatus according to still another embodiment of the present invention.

FIG. 7 is a block diagram of the speech recognition apparatus of this embodiment.

Referring to FIG. 7, the speech recognition apparatus includes a microphone 201, an A/D converter 202, a buffer memory 203, and a peak value detector circuit 204. The microphone 201 serves as a speech input unit for converting speech into an electical signal. The A/D converter 202 samples an analog speech input every 5 to 10 ms and quantizes the analog signal into a digital signal. The buffer memory 203 temporarily stores an output from the A/D converter 202. The peak value detector circuit 204 sequentially reads out data from the buffer memory 203 and calculates peak values. The peak value detector circuit 204 includes a CPU (Central Processing Unit) 204*a*, a ROM 204*b* for storing a program of a flow chart in FIG. 6, and a RAM 204*c* serving as a work area and for storing buffers d(1), d(2), and d(3) used for calculating peak values to be described later. The speech recognition apparatus also includes a buffer memory 205 and a peak value variation operation circuit 206. The buffer memory 205 temporarily stores an output from the peak value detector circuit 204. The peak value variation operation circuit 206 calculates a peak value variation as a funciton of time. The speech recognition apparatus further includes a feature or characteristic extraction unit 207, a buffer memory 208, a characteristic pattern integration unit 209, a memory 210, a pattern matching unit 211, and a discrimination result output unit 212. The characteristic extraction unit 207 consists of band-pass filters having 8 to 30 channels obtained by dividing a frequency range of 200 to 6,000 Hz. The characteristic extraction unit 207 extracts feature data such as a power signal and spectral data. The buffer memory 208 temporarily stores the input speech feature data until suitable feature parameters such as a power signal and spectral data are calculated. The characteristic pattern integration unit 209 integrates the output from the characteristic extraction unit 207 with the feature parameter associated with the peak value output by peak value variation operation circuit 206 to prepare a feature pattern of the speech input. The memory 210 stores standard patterns. The pattern matching unit 211 compares the input feature data with a readout standard pattern so as to calculate a similarity therebetween. The discrimination result output unit 212 outputs, as the recognition result, the standard pattern having the maximum similarity to the input feature data. This similarity is calculated by the pattern matching unit 211.

The operation of the speech recognition apparatus will be described in detail hereinafter.

The speech input is converted by the A/D converter 202 to a digital signal. The digital signal is sent to the peak value detector circuit 204 and the characteristic extration unit 207 through the buffer memory 203. The sampling frequency of the A/D converter 202 and the number of quantized bits for each sample are variable. However, in this embodiment, the sampling frequency is 12 kHz, and each sample comprises 12 bits (one of the 12 bits is a sign bit). In this case, a one-second speech input is represented by 12,000 bits of data.

FIG. 5 is a graph showing outputs from the A/D converter 202.

A/D conversion is performed on a real-time basis. For this reason, the buffer memory 203 is arranged in front of the peak value detector circuit 204. The peak value detector circuit 204 sequentially reads out the sampled data from the buffer memory 203.

FIG. 6 is a flow chart for explaining the operation of the CPU 204*a* in the peak value detector circuit 204.

Data from the buffer memory 203 is selectively stored into the register d(1), d(2), and d(3) of the RAM 204*c*. Numerals in parentheses denote sampled data numbers. Reference symbol d+ denotes a positive peak value; and d−, a negative peak value.

Referring to FIG. 6 in step S1, the first two data signals are read out from the buffer memory 203 and stored into the registers d(1) and d(2), respectively. The CPU 204*a* determines in step S2 whether all data in the buffer memory 203 is read out. If YES in step S2, processing is ended in step S9. However, if NO in step S2, the flow advances to step S3. The next data is read out from the buffer memory 103 and stored in the register d(3).

The registers d(1), d(2), and d(3) are compared in steps 4 and 6. For example, if d(1)<d(2), d(2)>d(3), and d(2)>0, then d(2) represents a positive peak value. If d(1)>d(2), d(2)<d(3), and d(2)<0, then d(2) represents a negative peak value. When one of the above conditions is satisfied, d(2) is stored in either d+ or d− in steps S5 and S7 respectively. Data representing the order of the stored data is stored, and the flow advances to step S8.

However, if neither if the above conditions is satisfied, the flow advances directly to step S8. In step S8, the current d(2) is stored into d(1), and similarly d(3) is stored in d(2). The flow advances to step S2 to check whether all data from the buffer memory 203 has been read. If YES in step S2, the flow advances to step S9 and processing is ended. If NO in step S2, new data is read out from the buffer memory 203 and stored in d(3). The above operation is then repeated to complete all data processing.

The amount of the data is a value obtained by multiplying the measurement time by 12,000.

In order to calculate the peak value, the following operation will be performed.

Description for Calculating Positive Peak Value

If d(1)≦d(2) then d(2) and d(3) are compared. If d(3)<d(2), then 2 is a peak so that the value of d(2) is a peak value. The sign of d(2) is checked to determine whether it is a positive value. If d(2)>0, d(2) is stored into d+. The values d+ and n are stored, and the operations in step S8 and the subsequent steps are performed.

Otherwise, e.g., if d(3)≧d(2) and d(2)≦0, then the operations in step S8 and the subsequent steps are performed.

Description for Calculating Negative Peak Value

If d(1)≧d(2), d(2) and d(3) are further compared.

If d(3)>d(2), 2 is a peak so that the value of d(2) is a peak value. The sign of d(2) is checked to determine if d(2) is a negative value. If d(2)<0, d(2) is stored into d−. The values of d− and n are saved, and the operations in step S8 and the subsequent steps are performed.

Otherwise, e.g., if d(3)≦d(2) and d(2)≧0, the operations in step S8 and the subsequent steps are directly performed.

Referring to FIG. 5, the positions of the positive and negative peak values d+ and d− obtained by the peak value detector circuit 204 are represented by symbols ▽ and ▲.

The peak value variation operation circuit 206 calculates the following feature parameters according to an output from the peak value detector circuit 204, and terms d+(n) and d−(n) in the mathematical expressions respectively represent a combination of time data n and peak value data d+ and a combination of time data n and peak value data d−:

Feature Parameters

Ratio of Sum of Positive Peak Values to Sum of Negative Peak Values Within Predetermined Period of Time:

$$p^1=\Sigma\{d+(n);n\leqq T\}/\Sigma\{d-(n);n\leqq T\}$$

Ratios of Adjacent Peak Values of Identical Sign and Their Distances:

$$p^2=d+(n-1)/d+(n)$$

$$p^2(n,t)=\{\text{time for } n \text{ in } d+(n)\}-\{\text{time for } n-1 \text{ in } d+(n-1)\}$$

and $$p^3=|d-(n-1)|/|d-(n)|$$

$$p^3(n,t)=\{\text{time for } n \text{ in } d-(n)\}-\{\text{time for } n-1 \text{ in } d-(n-1)\}$$

Ratios of Adjacent Peak Values of Different Signs and Their Distances:

$$p^4(n,+)=d+(n-1)/|d-(n)|$$

$$p^4(n,t)=\{\text{time for } n \text{ in } d+(n)\}-\{\text{time for } n-1 \text{ in } d-(n-1)\}$$

and $$p^5(n,-)=|d-(n-1)|/d+(n)$$

$$p^5(n,t)=\{\text{time for } n \text{ in } d+(n)\}-\{\text{time for } n-1 \text{ in } d-(n-1)\}$$

The characteristic pattern integration unit 209 integrates the feature patterns output from the characteristic extraction unit 207 and stored in the buffer memory 208 with the output from the peak value variation operation circuit 206 to prepare a new feature pattern of the speech input. The new feature pattern is simply referred to as a feature pattern hereinafter.

In the above embodiment, the speech input is sampled at a frequency of 12 kHz. The feature; patterns integrated by the characteristic pattern integration unit 209 are set according to the following standards. In other words, the standard patterns stored in the standard pattern memory 210 are selected according to the following standards:

1) Discriminating Between Voiced Sound And Voiceless Sound

If a difference between the values of d+(n) and d−(n) is 100 ms or more, and condition p4(n,+)>1.3 or $p^5(n,-)>0.76$ is satisfied, the speech input is discriminated as a voiced sound. Otherwise, the speech input is determined as a voiceless sound.

2) Discriminating Between Silent Sound And Voiceless Consonant

Among the speech inputs discriminated as voiceless sounds in standard (1), if condition $p2(n,t)<3$ or $p^3(n,t)<3$ is satisfied, the speech input is discriminated as silence. Otherwise, the speech input is discriminated as a voiceless consonant.

3) Discriminating Between Vowel And Consonant

Among the speech inputs discriminated as voiced sounds in standard (1), if $p1>1.5$, then the speech input is discriminated as a vowel. Otherwise, the speech input is discriminated as a consonant.

The variation over time of the peak value of the speech input and the discrimination result of each phoneme are integrated by the characteristic pattern integration unit 209 into the feature pattern of the speech input, thereby setting more accurate features of the speech data.

The pattern matching unit 211 sequentially reads out the standard patterns from the memory 210 and compares the standard patterns with the feature patterns from the characteristic pattern integration unit 209, and calculates similarities therebetween and sends the standard pattern having a maximum similarity to the discrimination result output unit 212, thereby obtaining the corresponding standard pattern.

In the above embodiment, the data of variation over time in the peak value is integrated as a feature parameter of the speech data to perform speech recognition processing. However, a speech spectrum zero-crossing number per unit time or an intensity ratio of speech spectra per unit time may be used to obtain the same effect as in the above embodiment.

In the above embodiment, the speech input is sampled at the frequency of 12 kHz. However, the sampling frequency is not limited to 12 kHz. In the above embodiment, one sample consists of 12 bits. However, the number of bits is not limited to 12.

What is claimed is:

1. An apparatus for receiving speech data input thereto, comprising:

input means for inputting speech data;

detecting means for detecting a plurality of sets of maximums and minimums of adjacent peak values of different signs of the input speech data;

memory means for storing the plurality of maximums and minimums detected by said detecting means;

determining means for determining a ratio of stored maximums and/or minimums of adjacent peak values;

operating means, using the result of the determining by said determining means, for calculating a characteristic variation over time of a correlation value of each group of the plurality of maximums stored in said memory means and calculating a characteristic variation over time of a correlation value of each group of the plurality of minimums stored in said memory means;

a plurality of dictionary means for storing a plurality of standard speech data; and preliminary selecting means for preliminarily selecting one of said dictionary means in accordance with the calculated characteristic variation over time of the correlation value.

2. An apparatus according to claim 1, further comprising:

a register for holding the calculated variation over time of the correlation values of each group of the plurality of maximums and minimums of the input speech data detected by said detecting means until the preliminary selection has been completed; and recognition means for recognizing the input speech data by selecting one of plural selected recognition candidates by comparing the recognition candidates with the calculated characteristic variation over time of the correlation value of each group of the plurality of maximums and minimums of said input speech data held by said register.

3. The apparatus according to claim 1, wherein said determining means calculates the ratio of the sum of stored maximums of positive peak values to the sum of stored minimums of negative peak values within a predetermined period of time.

4. The apparatus according to claim 1, wherein said determining means calculates the ratio of the maximums of adjacent peak values of identical sign and calculates the ratio of the minimums of adjacent peak values of identical sign.

5. The apparatus according to claim 1, wherein said values of different signs comprises a maximum peak value of one sign and a minimum peak value of the opposite sign.

6. A method of recognizing input speech data, comprising the steps of:

inputting speech data into a speech data receiving apparatus with input means;

detecting a plurality of sets of maximums and minimums of adjacent peak values of different signs of the input speech data;

storing the plurality of maximums and minimums in memory means;

determining a ratio of stored maximums and/or minimums of adjacent peak values;

calculating, using the result of the determining in said determining step, a characteristic variation over time of a correlation value of each group of the plurality of maximums stored in said storing step and a characteristic variation over time of a correlation value of each group of the plurality of minimums stored in said storing step;

providing a plurality of dictionary means for storing a plurality of standard speech data; and preliminarily selecting one of said dictionary means in accordance with the calculated characteristic variation over time of the correlation value.

7. A method according to claim 6, further comprising the steps of:

holding the plurality of maximums and minimums of the input speech data detected in said detecting step in a register until the preliminary selection has been completed in said preliminary selecting step; and recognizing the input speech data by selecting one of plural selected recognition candidates by comparing the selected recognition candidates with the calculated characteristic variation over time of the correlation value of each group of the plurality of maximums and minimums of the input speech data input in said inputting step held in said holding step.

8. The method according to claim 6, wherein said determining step calculates the ratio of the sum of stored maximums of positive peak values to the sum of stored minimums of negative peak values within a predetermined period of time.

9. The method according to claim 6, wherein said determining step calculates the ratio of the maximums of adjacent peak values of identical sign and calculates the ratio of the minimums of adjacent peak values of identical sign.

10. The method according to claim 6, wherein said determining step calculates the ratio of adjacent peak values of different signs comprising a maximum peak value of one sign and a minimum peak value of the opposite sign.

* * * * *

UNITED STATES PATENT AND TRADEMARK OFFICE

CERTIFICATE OF CORRECTION

PATENT NO. : 5,774,851

DATED : June 30, 1998

INVENTOR : KOICHI MIYASHIBA, ET AL.

It is certified that error appears in the above-identified patent and that said Letters Patent is hereby corrected as shown below:

COLUMN 3,
Line 60, "a-chart" should read --a chart--.

COLUMN 7,
Line 20, "10In" should read --$10_3$. In--.
Line 21, "according an" should read --according to an--.
Line 40, "±0.01 S" should read --±0.01S--.
Line 62, "time" should read --times--.

COLUMN 8,
Line 45, "devices," should read --device,--.

COLUMN 10,
Line 3, "value;" should read --value.--.
Line 17, "procesisng" should read --processing--.

COLUMN 12,
Line 11, "number-of" should read --number of--.

COLUMN 14,
Line 49, "stored" should read --stores--.
Line 55, "feature;" should read --feature--.

UNITED STATES PATENT AND TRADEMARK OFFICE

CERTIFICATE OF CORRECTION

PATENT NO. : 5,774,851

DATED : June 30, 1998

INVENTOR : KOICHI MIYASHIBA, ET AL.

It is certified that error appears in the above-identified patent and that said Letters Patent is hereby corrected as shown below:

COLUMN 16,
Line 15, "comprises" should read --comprise--.

Signed and Sealed this

Twenty-first Day of September, 1999

*Attest:*

Q. TODD DICKINSON

*Attesting Officer*

*Acting Commissioner of Patents and Trademarks*